US007090702B2

(12) United States Patent
Badiali et al.

(10) Patent No.: US 7,090,702 B2
(45) **Date of Patent: *Aug. 15, 2006**

(54) CONTINUOUS TREATMENT SYSTEM OF YARNS WITH PROCESS FLUIDS, PARTICULARLY FOR THEIR MERCERIZATION UNDER TENSION

(75) Inventors: Roberto Badiali, Pordenone (IT); Mario Minuti, Soresina (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 438 days.

This patent is subject to a terminal disclaimer.

(21) Appl. No.: 10/446,922

(22) Filed: May 28, 2003

(65) Prior Publication Data

US 2003/0226382 A1 Dec. 11, 2003

(30) Foreign Application Priority Data

Jun. 5, 2002 (IT) ..... MI2002A1223

(51) Int. Cl.
*D06B 5/06* (2006.01)

(52) U.S. Cl. ..... 8/151.2; 8/152; 68/177; 68/179

(58) Field of Classification Search ..... 8/151.2, 8/152; 68/175, 176, 178, 179
See application file for complete search history.

(56) References Cited

U.S. PATENT DOCUMENTS

| | | | | | |
|---|---|---|---|---|---|
| 42,782 | A | * | 5/1864 | Meyer | 68/9 |
| 1,555,864 | A | * | 10/1925 | McConnell | 68/175 |
| 2,131,409 | A | | 9/1938 | Nai | |
| 2,622,961 | A | | 12/1952 | Finlyason et al. | |
| 2,725,276 | A | * | 11/1955 | Griset, Jr. | 8/151.2 |
| 3,330,134 | A | | 7/1967 | Carpenter | |
| 3,616,663 | A | * | 11/1971 | Matsuda | 68/184 |
| 3,783,138 | A | * | 1/1974 | Kawasaka | 528/388 |
| 4,006,612 | A | | 2/1977 | Theis | |
| 4,656,846 | A | * | 4/1987 | Damm | 68/207 |
| 4,862,546 | A | * | 9/1989 | von der Eltz et al. | 8/149.1 |
| 5,621,937 | A | * | 4/1997 | Georgantas | 8/149.3 |

FOREIGN PATENT DOCUMENTS

| | | | |
|---|---|---|---|
| DE | 26 16 922 | | 10/1977 |
| DE | 42 18 551 | | 12/1993 |
| DE | 42 18 550 | | 1/1994 |
| EP | 0 314 039 | | 5/1989 |
| FR | 1 584 999 | | 1/1970 |
| GB | 2 004 927 | * | 4/1979 |

* cited by examiner

*Primary Examiner*—Frankie L. Stinson
(74) *Attorney, Agent, or Firm*—James V. Costigan; Hedman & Costigan

(57) ABSTRACT

A continuous treatment system of yarns with process fluids, particularly for mercerization, wherein a bundle of threads to be treated is put into the reaction with a Venturi nozzle activated with process fluid, which entrains the bundle of yarn with it, and with a swirl distributor in the J-shaped treatment reactor, having an inner saddle-shaped guide surface for the downward and upward movement of the yarn in the process fluid bath.

11 Claims, 3 Drawing Sheets

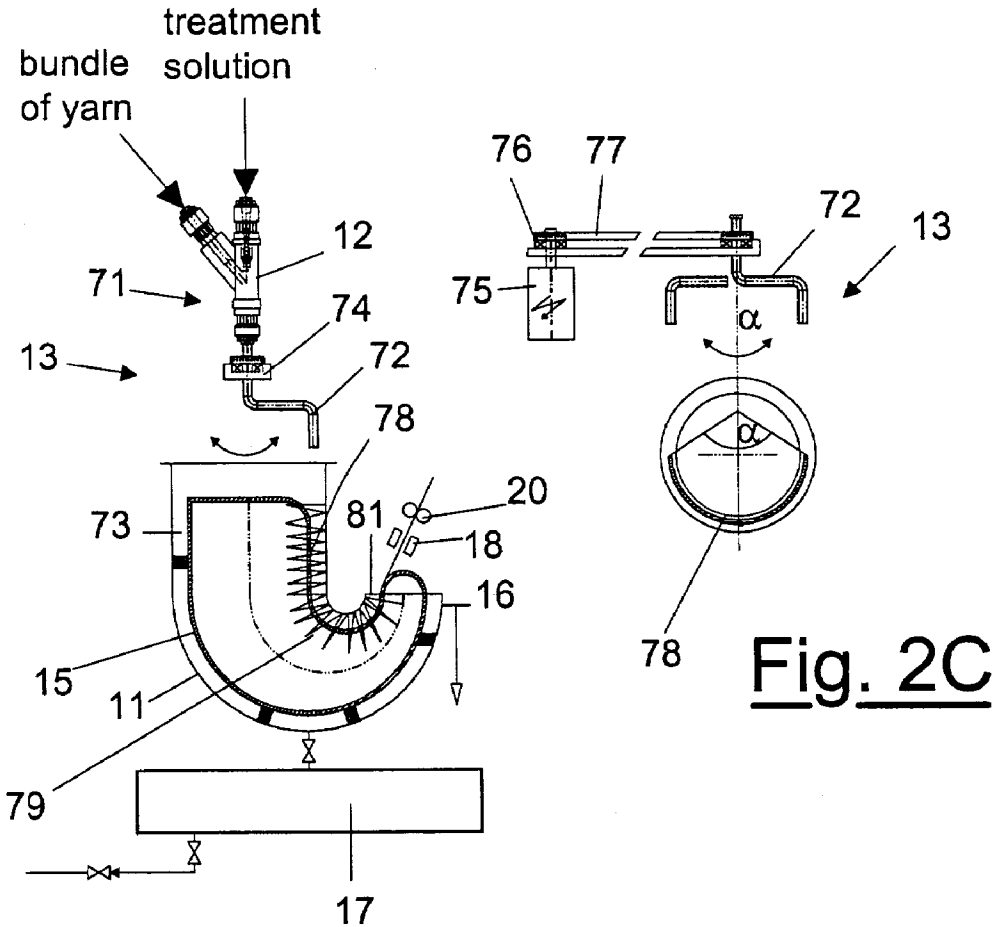
Fig. 2A
Fig. 2C
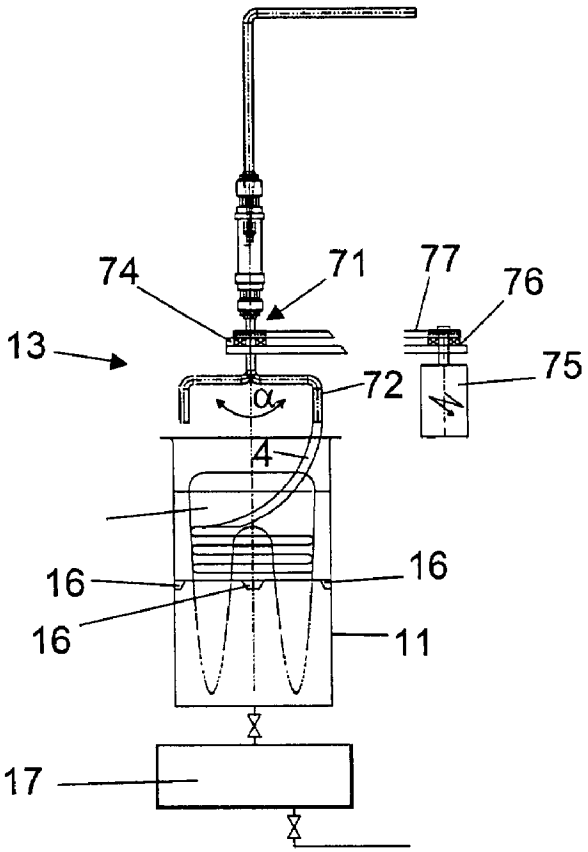
Fig. 2B

CONTINUOUS TREATMENT SYSTEM OF YARNS WITH PROCESS FLUIDS, PARTICULARLY FOR THEIR MERCERIZATION UNDER TENSION

The present invention relates to the treatment of yarns with process fluids to give them the desired characteristics before their final use for producing fabrics or other end-products.

In textile technology, the treatment of yarn with fluids, or more specifically with process liquids, is adopted for a wide variety of processings, for different types of fibres such as cotton, woolen, silk, linen, etc., which give the yarn the desired characteristics or remove undesired components that reduce their value and the possibility of use for producing end-products. For cotton, for example, this type of treatment can relate to dyeing, mercerizing, bleaching, washing, sizing and so forth.

In industrial practice, these treatment operations are generally effected with batch operations on discrete lots of yarns, specifically prepared in bobbins or skeins, which must then be reeled off and re-prepared differently in the production line which leads to the end-product.

Batch processing on yarn is generally extremely onerous due to the considerable labour involved, the low performance of the process fluids, the high plant investments and finally for the environmental implications caused by the reagents discharged with the waste water which consequently require further costs in order to ensure that the drain water is within specification. Batch treatments also have the additional problem of quality constancy of the product for each processing batch, depending on the variability of the parameters of each single batch processing such as temperatures, times, concentrations, etc.

The economy, efficiency and constancy of the quality of the yarn treated with continuous processing is therefore determinant for the commercial success of the overall yarn production process.

To provide a better illustration of the characteristics of the continuous treatment system of yarn with process fluids, in the description of the present invention, reference is made to the mercerization technology—also called mercerizing—under tension of cotton, which represents a typical case of yarn treatment with process solutions; it should be explicitly specified, however, that the continuous treatment system of yarn according to the present invention can also be advantageously used for other treatment to be effected on yarns in textile technology.

In the known art, mercerizing is typically effected on yarn in skeins, specifically prepared with a reeling step, subjected to batch mercerization, and subsequently washed, dried, reeled off and re-prepared in bobbins. Broadly speaking, mercerization consists in treating the yarn with alkaline solutions—typically caustic soda but possibly also with other alkaline hydrates—at a high concentration followed by drawing which basically enhances the yarn considerably, with respect to gloss, higher mechanical properties and improved dyeability, modifying the characteristics and form of the single fibres which make up the yarn.

Proposals have also been made in the known art to treat yarns with mercerizing solutions by first preparing the single threads with winding into beams, each having hundreds of threads. The threads are unwound from the beams in parallel, passed individually in a sequence of tanks at atmospheric pressure containing soda baths and other treatment fluids, drawn by pairs of rolls and rewound onto other beams or onto single spools. The spools of mercerized yarn are then charged onto bobbin winders to be collected into bobbins. These technical solutions are extremely complicated, they have numerous disadvantages and for the moment have not been widely diffused on the market. The soda baths, for example, have large dimensions; this results in high costs for the plant and technical immobilizations and also a low efficiency of the soda baths. The large surfaces of the mercerizing baths are in contact with the air and their sodium hydrate is subject to rapid deterioration by carbonation due to contact with the carbon dioxide in the overlying air. The breakage of one of the threads being treated is difficult to detect and the skein ends difficult to recover, and in any case the processing must be interrupted.

An objective of the present invention is to provide a continuous treatment system of yarns with process fluids, which allows the drawbacks of the systems available in the known art, to be overcome.

This objective is achieved in accordance with the present invention with the treatment system according to the most general definition of claim 1 and for preferred embodiments or possible variants defined in the dependant claims from 2 to 8. The present invention also allows a continuous treatment system of yarns to be provided, and in particular for the mercerization of yarns, according to claim 9 and its dependant claims.

The characteristics and advantages of the system according to the present invention for the continuous treatment of yarns with process fluids will appear more evident from the following illustrative but non-limiting description, referring to its application to the continuous mercerizing under tension of cotton, according to the plant scheme illustrated in FIG. 1.

FIGS. 2A, 2B and 2C illustrate the constructive and functional characteristics of the continuous treatment reactors according to the invention.

Figure 3:
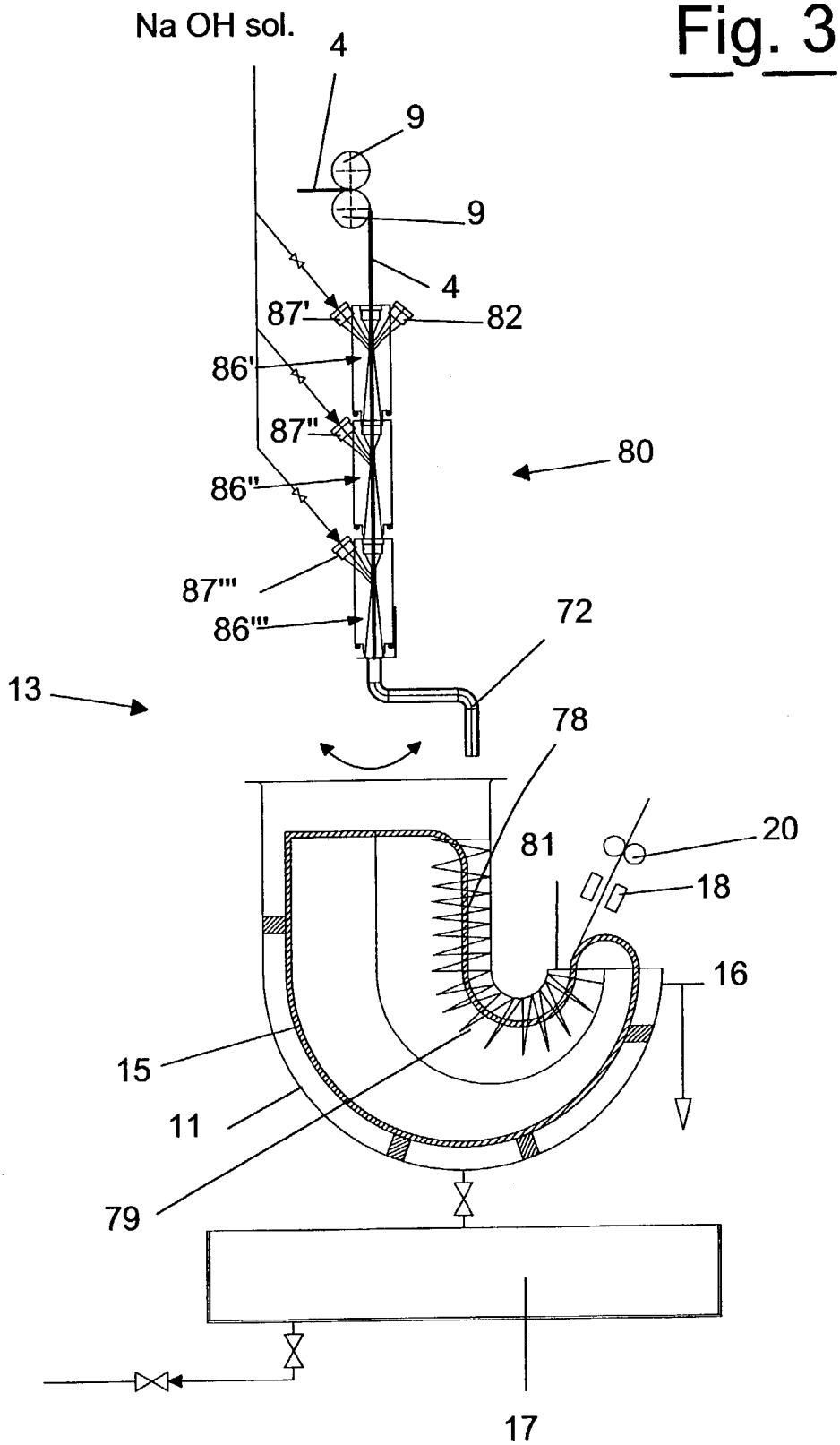

FIG. 3, on the other hand, shows an embodiment variation of the ejector which forms the first part of the mercerizing reactor.

Figure 1:
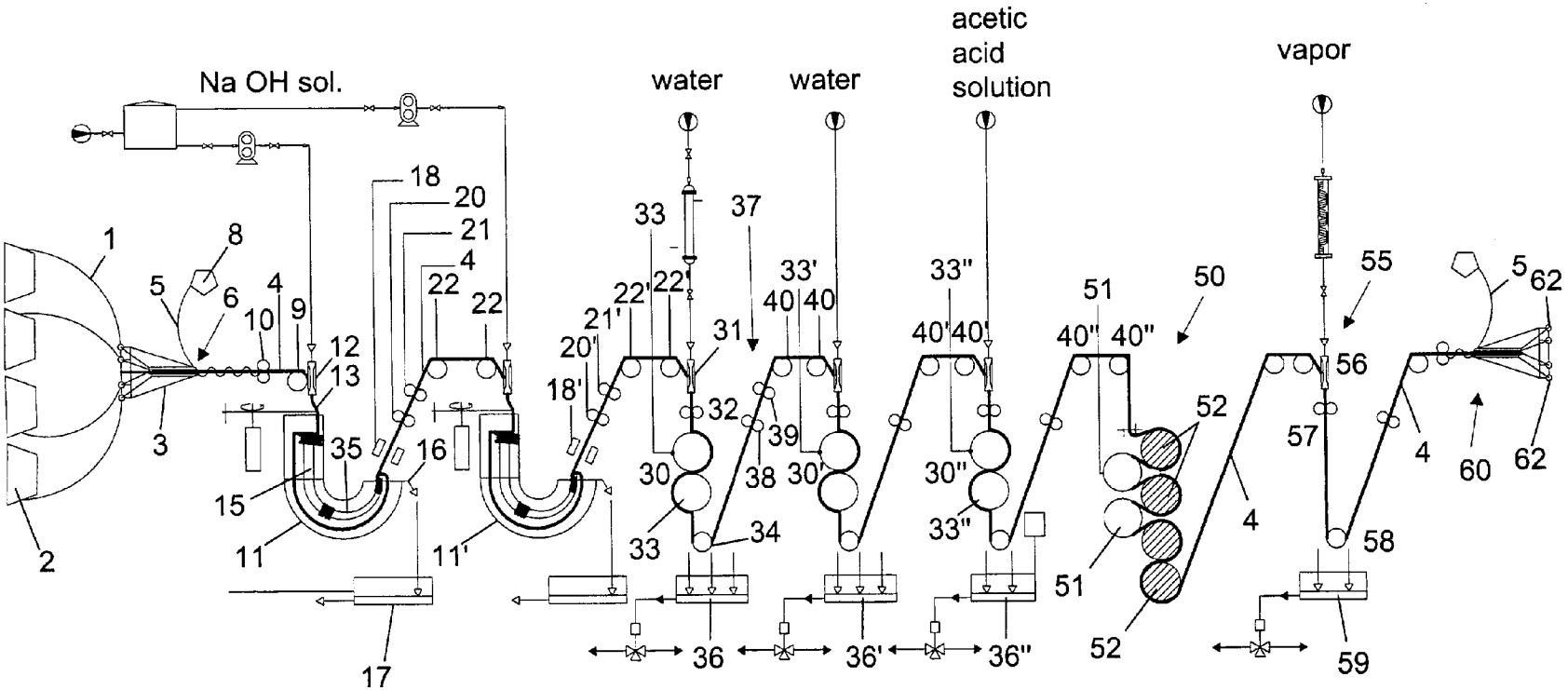
FIG. 1 illustrates the general scheme of the treatment system of yarns with process fluids.

In the general scheme of FIG. 1, the yarn 1 to be treated is fed starting from a series of bobbins 2 arranged in parallel on specific unwinding creels, not shown in the figure for the sake of simplicity, which release a series of parallel threads which are concentrated in a cable laying funnel 3 forming a bundle 4 of threads adhering to each other. In principle, the system can also operate on a single thread 1, but the industrial application of the invention is more interesting—for its productivity—with numerous threads, preferably with a bundle 4 consisting of from 20 to 200 threads or more, also depending on the titer of the yarn being processed.

In order to increase the solidarity of the threads contained in the bundle 4 of threads to be processed, according to a preferred embodiment of the invention, in section 6 for the preparation of the bundle of threads, at least one auxiliary thread 5 with long coils, indicatively having a shed of 200 to 1500 mm, is wound around them, accompanying the bundle during its processing, and is subsequently separated and recovered at the end of the processing line. This expedient, in the case of the breakage of one or more threads 1, prevents them from not continuing their run through the overall machinery but, with continuous feeding, they accumulate in one of the continuous processing machines.

For example, as shown in FIG. 1, the winding is effected with one or more auxiliary threads 5 with a high chemical and mechanical resistance—for example made of Kevlar—which are released from one or more bobbins 8 held by a rotating reel, not shown in the figure for the sake of simplicity, around the bundle 4 and rotating according to the arrow A. An alternative for increasing the adherence between the threads of the bundle 4 can be to apply a slight twisting to the bundle itself, a few twists per meter, assembling the unwinding creels of the bobbins 2 on a rotating support, according to the rope-making technique.

The pulling of the threads 1 to form the bundle 4 is effected with the pair of guiding rolls 10, which rotate at a controlled rate and which determine the linear pulling-rate of the bundle 4 of threads being processed, generally at a rate in the order of hundreds of m/min, sending it to the mercerizing reactors.

An important characteristic of the present invention consists in the treatment operation and structure of the reactor in which the treatment of the bundle 4 of threads is effected with the process fluid which, in the illustrative present description, consists of an alkaline solution of sodium hydrate at a high concentration. This operation is carried out in a reactor consisting of a sequence of an ejector or Venturi tube 12, a distributor 13 and a tank reactor 11, preferably a J-shaped tubular reactor, whose structure and components are described in more detail in FIG. 2.

The bundle of threads 4 is introduced into the mercerizing tank reactor 11, by means of the ejector 12 comprising a Venturi nozzle fed with a stream, under pressure, of the alkaline mercerizing solution, for example sodium hydrate at 30 Be, an abbreviation of Baumè degrees in the textile field, which corresponds to about 297 g/l of NaOH. The bundle 4, enters, by means of a deviator roll 9, into an inlet hole in correspondence with the depression of the contracted vein of the fluid which sucks the bundle of threads 4, pulled by the bobbins 2 with the initial guiding rolls 10 and then sent to the mercerizing tank reactor 11. The bundle of threads 4 is sent from the Venturi 12, by means of distributor 13, which is illustrated in greater detail with reference to FIG. 2, with a swirl configuration, into the peripheral interspace inside the tank reactor 11.

According to an important characteristic of the present invention, inside the tank reactor 11 there is a saddle-shaped guiding surface 35 of the layer of threads in swirls. The bundle of threads 4 continuously moves on this guiding surface, first with a downward movement of immersion in the bath and then with an upward movement of emersion from the treatment bath.

According to a perfected embodiment, the tank reactor 11 has the form of a J or asymmetrical U, with an entrance and exit at its ends. Inside there is an inaccessible metallic sheath 15, substantially coaxial with the reactor jacket and also J-shaped, which forms an interspace with a circular crown section, with an upper saddle 35 on which the yarn body positioned in swirls moves from the entrance to the exit, in contact with the caustic mercerizing solution which fills the interspace of the reactor up to its overflow level. The solution percolates in the bundle of threads which, deposited in swirls, for example, in a zigzag arrangement, on the external surface of the sheath 15, slowly moves along the J remaining in contact with the solution for the necessary time. The coaxial J-shaped structure of the external jacket of the reactor 11 and internal sheath 15 allows the internal volume of the treatment reactor to be reduced to the minimum necessary, thus reducing the quantity and residence time of the treatment solution in the reactor itself.

As is known, the effect of the alkaline mercerizing solution causes a considerable enlargement and shortening of the cotton thread and consequently of the bundle 4, with the result that the initial flow-rate in m/min of the bundle at the entrance is clearly reduced at the exit of the reactor. For example, 1000 metres of the bundle of threads 4 at the entrance can correspond to 600–700 metres of bundle at the exit. The depositing of the bundle in swirls enables this shortening of the bundle to be compensated without any drawbacks, and also maintains the textile material forming the bundle 4 in contact with the mercerizing solution for the necessary time, with a small reaction volume and with treatment uniformity on all the threads forming the bundle 4.

At the exit of the reactor 11, the liquid phase consisting of the alkaline solution is separated by overflow, filtered, reconditioned with respect to concentration and temperature, and then recycled for mercerization, according to the known processes. The mercerizing solution discharged at the overflow 16 is collected in the tank 17 and recycled. The bundle of threads 4, on the other hand, is pulled, with the control of its tension value by means of the sensor 18, using the discharge rolls 20 which pull the bundle at a rate corresponding to the shortening induced in the treatment in the reactor 11, for example at 60–70% of the arrival rate of the bundle at the Venturi 12. The discharge rolls 20 also act as gripping rolls for the drawing of the bundle 4 due to the effect of the drawing rolls 21, situated downstream of the gripping rolls and are rotated with a higher rate than the rolls 20, for example at 90% of the arrival rate of the bundle 4 at the Venturi 12, thus recovering most of the shortening induced in the thread fibres 1 and providing the tension necessary for fully receiving the benefits obtained from the mercerization. The yarn is then discharged by the directional deviator rolls 22.

The time phase shift between the transfer times of the bundle 4 to the reactor 11 with the initial guiding rolls 10 and the transfer times of its pulling with the discharge rolls 20 forms the residence time of the bundle 4 in the reactor 11.

The mercerization can be repeated once or several times to graduate its effect on the processed cotton. For illustrative purposes, FIG. 1 shows a second mercerizing reactor 11', completely analogous to the previous one and also J-shaped. The same numerical references refer to similar components and having the same function. Also for the reactor 11', the bundle of threads 4 is introduced with a Venturi nozzle device 12' fed with an alkaline mercerizing solution. Also in the second reactor, the mercerizing solution percolates in the bundle of threads, which, spirally wound in the sheath 15', slowly moves along the J remaining in contact with the solution for the necessary time.

Also in the second reaction step, the alkaline mercerizing solution again induces an enlargement and shortening of the threads forming the bundle 4, so that it is pulled with the discharge rolls 20' at a linear rate which corresponds to the new shortening induced with the treatment in the reactor 11'. The discharge rolls 20' and the drawing rolls 21', for example, operate completely analogously to the previous ones and with a linear rate which obtains a tension and induces drawing, recovering the length of the bundle for 90% of the initial arrival value of the bundle 4 at the Venturi 12. The yarn is then discharged by means of directional deviator rolls 22'.

In the second reactor 11', the treatment is perfected and a new shortening of the yarn is induced, which is again drawn in the section between the rolls 20' and 21' re-obtaining the value of 90% of the initial length which it had in correspondence with the initial guiding rolls 10.

After passage in the reactors 11 and 11', the bundle 4 is fed to the washing with water. According to a preferred embodiment of the invention, the washing is effected in several steps with water in countercurrent so that the last washing is carried out with the purest water and thus using the resulting water, containing the removed soda, for the next-to-last washing and so on. The water coming from the first washing, containing the soda removed in the series of washings, is then used to prepare the concentrated mercerizing solution. The illustrative scheme of FIG. 1 shows, to simplify the drawing, two washing steps in countercurrent.

The mercerized bundle of threads 4, guided by the directional rolls 22', is introduced into the first washing step in the unit 30, by means of the Venturi nozzle 31 fed with a pressurized stream of washing water coming from the subsequent step. Analogously to the previous mercerizing reaction steps, the bundle 4 enters the Venturi 31 in correspondence with one of its side holes in correspondence of the depression caused by the contracted vein of the fluid which sucks the bundle of threads 4, creating close contact between the threads forming the bundle and the washing water. The bundle 4 leaving the Venturi is pulled downwards by two guiding rolls 32, subsequently follows the S-run between two or more facing cylinders 33 which, upon squeezing, remove most of the water with which the bundle of threads 4 is soaked, and reaches the deviator roll 34.

The resulting washing water is collected in an underlying tank 36 and re-used. Downstream of the deviator roll 34, there is a final drawing unit 37, inserted between the two washing steps. This consists of a pair of gripping rolls 38, and a subsequent pair of drawing rolls 39, whose function, for example, is to restore the initial length of the bundle of threads 4. The gripping rolls 38 operate at the linear rate of the guiding rolls 32 with which the bundle 4 leaves the Venturi. The subsequent drawing rolls 39, for example, are activated, on the contrary, at the same linear rate as that of the arrival of the bundle 4 at the Venturi 12, thus completely recovering the entire shortening induced in the threads 1 and giving the definite mercerizing tension. The yarn is then discharged with the directional deviator rolls 40.

Again for illustrative purposes, FIG. 1 shows a second washing unit 30', completely analogous to the previous unit 30. The same reference numbers refer to similar components and with the same function. The Venturi nozzle 31' is fed with a pressurized stream of the purest washing water, whereas the water coming from the second unit 30' is used as feeding in the first unit 30.

The bundle of threads 4 washed in units 30 and 30', is then subjected to a neutralization step with an organic acid, generally with diluted solutions of acetic acid, citric acid or similar products, to remove the last traces of alkalis still remaining in the yarn fibres. The neutralization unit 30" is completely analogous to the washing units 30 and 30' and also operates with a Venturi nozzle 31", this time fed for example with a pressurized stream of a diluted solution of acetic acid to remove the alkaline residue from the threads of the bundle 4. Analogously to the previous washing units, the bundle 4 leaving the Venturi 31" is pulled downwards by two guiding rolls 32", follows an S-run between the squeezing cylinders 33" and arrives at the deviator 34". The neutralization solution is collected in the underlying tank 36" and is recycled; the pH of the resulting acetic solution is checked in the tank for any possible corrections to be made to its titer and to verify the neutralization trend.

The bundle of threads 4 washed in units 30, 30' and neutralized in unit 30", is then subjected to a complete drying step, for example in the drying unit 50 with a winding path around the cylindrical surfaces of a series of squeezing cylinders 51 and drying cylinders 52 heated with diathermic oil. According to an embodiment variation of the invention, the bundle 4, after the drying step in unit 50, is subjected to treatment with vapor in the vaporization unit 55 to recondition the thread and bring it to the humidity conditions according to the specification required by the user downstream.

In the vaporization unit of the bundle of threads 4, analogously to the procedure adopted in the previous steps, the treatment is always effected in a contact device consisting of a Venturi nozzle 56 into which the bundle 4 is introduced in correspondence with the depression of the contracted vein of the fluid which sucks the bundle of threads 4, creating close contact between the threads forming the bundle and the saturated treatment vapor. The bundle 4 leaving the Venturi nozzle is pulled downwards by two pairs of guiding rolls 57, 57', between which a deviator roll 58 is inserted, and the condensate falls into the collection tank 59.

The threads 1 forming the bundle of threads 4 thus mercerized are then separated in the separation unit 60 of the bundle 4, according to an inverse process with respect to that previously effected.

The first step consists in unwinding one or more auxiliary threads 5 initially wound, which are rewound onto one or more bobbins 61 held by a rotating reel, not shown in the figure for the sake of simplicity, around the bundle 4 and rotating according to the arrow B, in the opposite direction to the arrow A and with the same winding shed. The threads 1 become parallel again, are no longer constrained in the bundle and can be separated by passing them in the guide-threads 62 to be rewound onto separate bobbins of mercerized thread.

FIGS. 2A, 2B, 2C illustrate in more detail the structure and functioning of the J-shaped tubular reactor, as well as its auxiliary components. FIG. 2A shows a side view of the reactor and its service equipment, whereas FIG. 2B shows a view from the left and FIG. 2C the section of the reactor 11.

The distributor 13 is connected to the end part of the Venturi nozzle 12, from which the treatment solution flows, in the example, the mercerizing alkaline solution, which entrains with it the bundle of threads 4 at the rate established by the main guiding rolls 10. The connection of the distributor 13 is effected with a vertical cylindrical joint 71, which ends with a tube 72, for example in the form of a seat, having an eccentric terminal part capable of rotating around the axis of the cylindrical joint 71, depositing the yarn with swirls in the interspace 73 between the jacket of the reactor 11 and its central sheath 15. A pulley 74 is fitted on the initial cylindrical part of the tube 72, which is rotated by means of a motor 75, on whose axis a similar pulley 76 which carries a transmission belt 77, is assembled.

According to a preferred embodiment of the present invention, the motor 75 is an electric motor piloted in an alternating controlled rotation frequency, clockwise and anticlockwise, according to an $\alpha$ swing angles between 90° and 180°, for example with so-called brushless motors, or with step-by-step motors piloted in frequency by a processor which allows the thread to be deposited at a rate coherent with that of the rolls 10 and with a swirl form having an angular amplitude corresponding to the swing angles of the end of the tube 72. Both the Venturi nozzle 12 and the upper part of the tank reactor 11 are positioned with their axis in a vertical or subvertical position, i.e. deviated by a few degrees with respect to the vertical.

The swirls of the bundle of threads 4 being treated are deposited as a layer 78 which slowly descends onto the saddle 79 of the concave part of the inaccessible sheath 15 and then rises up to the outlet section 81, pulled by the discharge rolls 20.

Overflow mouths 16 are situated on the outlet edge of the jacket 11 of the treatment reactor, from which the treatment solution, for example the mercerizing solution, overflows into the underlying tank 17 from which the solution is then removed and reused.

The type of contact and residence times of the yarn of the bundle 4 in the reactor 11 can be regulated and controlled according to a large quantity of variables, with the same linear flow-rate of the bundle of threads 4 being treated. For example, the parameters can be—either jointly or separately—the variation of the α swing angle of the tube 72 of the distributor 13 or the swing frequency, by intervening on the piloting of the activation motor 75, or the delay or the pulling rate with the discharge rolls 20, by intervening on their activation.

The continuous treatment process of yarns with process fluids according to the present invention, and in particular the mercerizing process described above, allows considerable advantages to be obtained with respect to the processes of the known art. Among these a special mention should be made to the following characteristics.

According to the present invention, the treatment operations with process fluids are effected with continuous operations, and not on lots of yarn, without requiring previous preparation on bobbins or skeins followed by their unwinding and re-preparation.

According to the present invention, continuous yarn processing is more economical, due to the lesser amount of labour used, the high performance of the process fluids and washing water, the lower overall plant investments and finally fewer environmental implications as a result of the reduced quantity of reagents discharged with the waste water. The constancy of the product quality which is obtained with the continuous treatment system according to the present invention is considerably improved, due to the constancy of the parameters of each processing step which can be maintained at the desired temperature, time, concentration values, and so forth.

The conformation of the treatment tank reactor with a J-shaped interspace and Venturi nozzle inlet allows the treatment times and conditions to be regulated within a wide range. The type of contact, which takes place in two steps, allows an effective treatment. The first reaction step is effected, with shorter times, in the Venturi nozzle 12 and distributor 13; a high flow rate is established therein, with a vortical motion and brusque involvement also of the threads situated inside the bundle 4. The reaction is completed in the second reaction step which is effected in the interspace on the bundle deposited in swirls with a laminar motion in which the gradual and complete permeation of the solution takes place inside the single threads. The tank reactor 11 allows the contact times between the yarn and treatment solution to be prolonged until the desired result is obtained.

FIG. 3 illustrates an embodiment variation of the ejector 12 which forms the first part of the mercerizing reactor. In this variation, the single Venturi nozzle 12 described above is produced with a group 80 of two or more Venturi tubes situated in series in which the bundle of threads 4 passes in sequence from the first Venturi tube 80' to the subsequent Venturi tubes 80", 80'" and so on. The Venturi driving fluid always consists of the treatment solution, in the case described an alkaline mercerizing solution. In the embodiment illustrated, in FIG. 3 the entrances 81 of the pressurized driving fluid are positioned laterally, whereas the bundle of yarn 4 follows the straight run of the axis of the sequence 80 of Venturi nozzles. The stream of pressurized driving fluid is subdivided and distributed between the entrances 81', 81", . . . so as to gradually increase the volumetric ratio between the volume of mercerizing solution fed and the quantity of yarn being processed in the axial direction, between the beginning and end of the sequence. The bundle of yarn 4 being processed, again deviated by a deviator roll 9, enters into an axial direction from the first Venturi 80' and axially follows the whole sequence 80 receiving, in correspondence with each narrowing and depression of the contracted vein of the fluid, the arrival of the partialized stream of driving fluid from their entrances 81. Along the path of the yarn 4 there is consequently a considerable pulsation of contact conditions, such as rate and pressures of the fluid which flows around the bundle of threads 4. A second further embodiment variation of the invention contemplates, in correspondence with the first entrance 81 for the process fluid, an entrance 82 for service connection with compressed air, both for maintenance operations and for the activation of the reaction unit with the insertion of the bundle 4 in the sequence of Venturi tubes 80.

This embodiment variation of the ejectors 12 with several Venturi nozzles 80 in series allows a more effective contact and sealing for the fluids and can be adopted both for mercerizing reactors and for the subsequent washing and neutralization operations of the yarn 4 after the treatment with alkaline solutions.

The invention claimed is:

1. A system for continuous treatment of yarns with process fluids characterized in that it comprises:

means for preparing and feeding (10) of a single thread or bundle (4) of various threads (1), means for introducing the yarn in the bundle (4) fed for treatment by suction with a Venturi nozzle (12), in which the process fluid is fed as driving fluid under pressure, entraining with it the bundle of yarn (4), distributing devices (13) which receive the bundle of yarn (4) and distribute it into a treatment reactor (11) forming a layer with superimposed swirls, one or more tank reactors (11) which receive the bundle of threads (4) together with the process fluid, internally containing a saddle-shaped guiding surface (79) on which the bundle of threads (4) deposited in a layer of swirls moves continuously first with a downward motion immersing it in a process fluid bath, and then with an upward motion with emersion from the bath, rising to an exit by the pulling of discharge rolls (20).

2. Continuous treatment system of yarns with process fluids according to claim 1, wherein reactors (11) are J-shaped, characterized by a straight portion and a concave, portion, an outer jacket, and a internal central inaccessible sheath (15), also J-shaped, the bundle (4) is continuously wrapped around an internal central inaccessible sheath in the form of swirls descending in a layer on the concave part of the inaccessible sheath (15).

3. Continuous treatment system of yarns with process fluids according to claim 1, characterized in that the Venturi nozzle (12) consists of a group (80) of Venturi tubes (80', 80", 80'") situated in series in which the bundle of threads (4) passes in sequence.

4. Continuous treatment system of yarns with process fluids according to claim 1, characterized in that the preparation and feeding means of the bundle of threads (4) comprise a cable laying funnel (3) and devices for winding onto the bundle of threads (4), one or more auxiliary threads (5) with longs coils, with a shed of 300 to 1500 mm, forming a bundle of threads (4) adhering to each other.

5. Continuous treatment system of yarns with process fluids according to claim 1, characterized in that the bundle of threads (4) is made up of from 20 to 200 threads.

6. Continuous treatment system of yarns with process fluids according to claim 1, characterized in that the distributing devices (13) are connected to the end part of the Venturi nozzle (12) by means of a cylindrical joint (71) which ends with an eccentric terminal part capable of rotating around the axis of the cylindrical joint (71), depositing the yarn with swirls in the interspace (73) between the outer jacket of the reactor (11) and its central sheath (15), said distributor being equipped with a rotating activating device with an alternating angular swing in the clockwise and anticlockwise, direction.

7. Continuous treatment system of yarns with process fluids according to claim 6, characterized in that the clockwise and anticlockwise, alternating angular swing is activated according to ($\alpha$) rotation angles ranging from 90° to 180°.

8. Continuous treatment system of yarns with process fluids according to claim 6, characterized in that the rotating activating device with an alternating swing of the distributor (13) is an electric motor (75) piloted in frequency.

9. A mercerization process of yarns comprising one or more treatment steps of the yarn with an alkaline solution, one or more drawing steps of the yarn after the alkaline treatment, one or more aqueous washing and neutralization steps of the alkalinity residue still present in the yarn, characterized in that:

the process is carried out continuously on threads of yarn collected in a bundle (4) prepared in a section (6) in which solidarity is conferred between the threads, and subsequently fed with a feeding device (10), the bundle (4) is introduced for mercerization treatment by suction with a Venturi nozzle (12), in which the alkaline mercerizing solution is fed as driving fluid under pressure, entraining with it the bundle of yarn (4)

the bundle (4) is introduced for mercerization treatment with distributing devices (13) which receive the bundle of yarn (4) from the Venturi nozzle (12) together with the alkaline mercerizing solution, and distribute it in a treatment reactor forming a layer with the superimposed swirls, in one or more reactors (11), internally equipped with a saddle-shaped surface (79) on which the bundle (4) in swirls descends in a layer on its concave part and rises up to the exit, pulled by discharge rolls (20), the bundle (4) is then drawn in continuous in one or more drawing units consisting of gripping and discharge rolls (20) and drawing rolls (21), situated downstream, which are rotated with a higher rate than the rolls (20).

10. The mercerization process of yarns according to claim 9, characterized in that the reactors (11) are J-shaped, and have a straight portion, a concave portion, an outer jacket, and an internal central inaccessible sheath (15), also J-shaped, the bundle (4) is continuously wrapped around the central sheath in the form of swirls descending in a layer along the concave part of the inaccessible sheath (15).

11. The mercerization process of yarns according to claim 9, characterized in that the further treatment steps of the mercerized yarn after drawing with process fluids are carried out in continuous by putting the bundle (4) in contact with said process fluids in Venturi nozzles (31, 31', 31", 56) into each of which the process fluid is fed as driving fluid, entraining with it the bundle of yarn (4).

* * * * *